US008573597B1

(12) United States Patent
Oh

(10) Patent No.: US 8,573,597 B1
(45) Date of Patent: Nov. 5, 2013

(54) BACCARAT IMPROVEMENTS

(71) Applicant: Han Suk Oh, Catonsville, MD (US)

(72) Inventor: Han Suk Oh, Catonsville, MD (US)

( * ) Notice: Subject to any disclaimer, the term of this patent is extended or adjusted under 35 U.S.C. 154(b) by 0 days.

(21) Appl. No.: 13/624,349

(22) Filed: Sep. 21, 2012

(51) Int. Cl.
*A63F 1/00* (2006.01)

(52) U.S. Cl.
USPC ..... 273/292; 463/12

(58) Field of Classification Search
USPC ..... 273/292, 274, 309; 463/12
See application file for complete search history.

(56) References Cited

U.S. PATENT DOCUMENTS 6,733,012 B2 * 5/2004 Bui et al. ..... 273/292
6,789,801 B2 * 9/2004 Snow ..... 273/292
7,309,065 B2 * 12/2007 Yoseloff et al. ..... 273/292
8,308,542 B2 * 11/2012 Daines ..... 463/12

* cited by examiner

*Primary Examiner* — Benjamin Layno

(57) ABSTRACT

A method of playing Baccarat and Baccarat derivative games such as mini-Baccarat and midi-Baccarat which incorporates an optional side bet, without affecting the normal play. The bettors may wager on this side bet, which has a payout based on an occurrence of a natural (two-card) 8-count or 9-count and loses if either no natural occurs, or bettors chose a side that did not have a natural. The Natural side bet may be wagered on either Player side being a natural or the Banker side being a natural. Bettors may win a larger amount on the Natural side bet if specific conditions arise when both the Player and Banker has a natural. In preferred embodiments, the side bets are made electronically via touch screens, and the cards are scanned electronically in a manually dealt shoe or with an electronic shoe simulating physical cards using a computer.

2 Claims, 1 Drawing Sheet

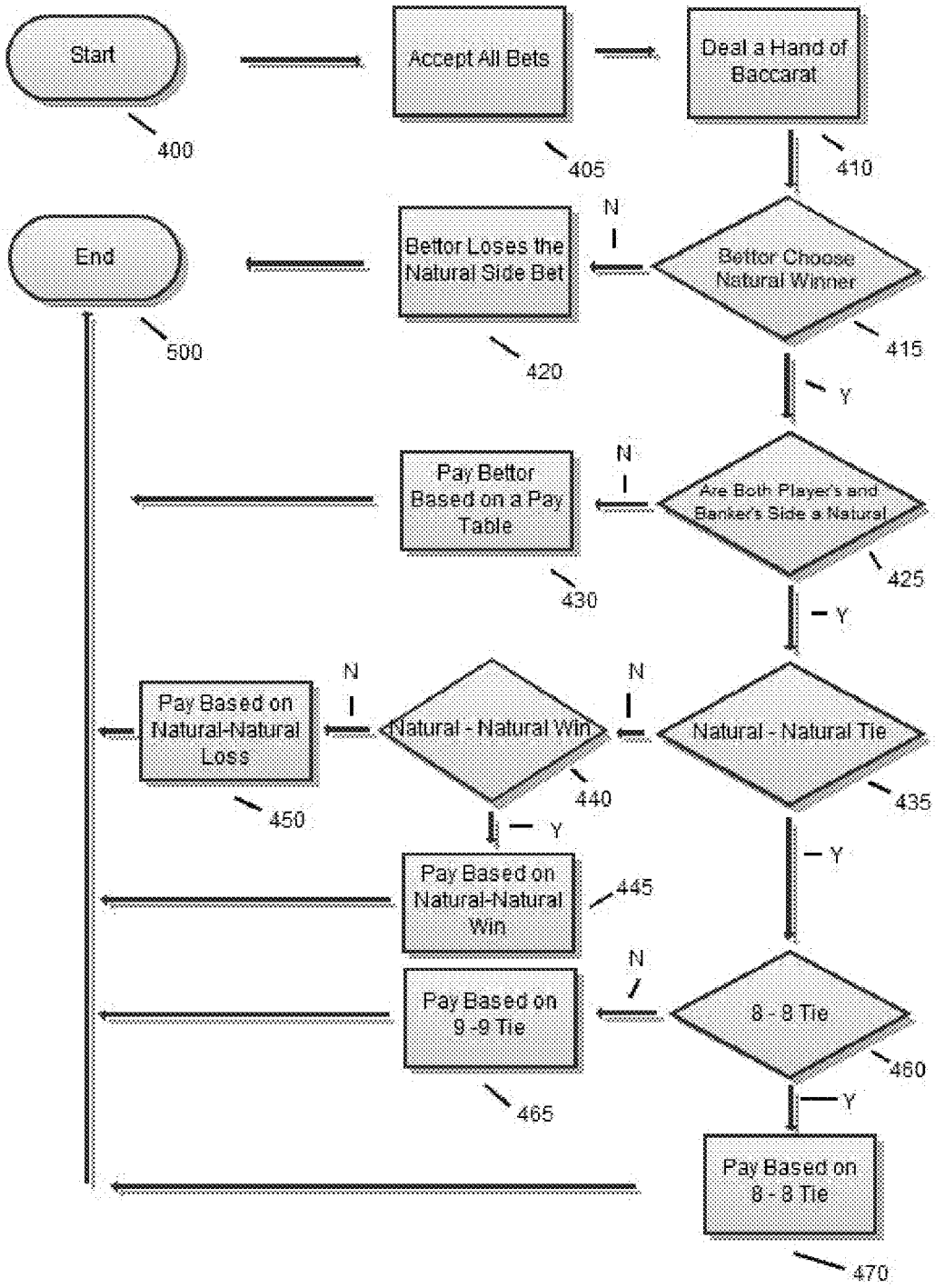
Start
400
Accept All Bets
405
Deal a Hand of Baccarat
410
Bettor Choose Natural Winner
415
N
Bettor Loses the Natural Side Bet
420
End
500
Y
Are Both Player's and Banker's Side a Natural
425
N
Pay Bettor Based on a Pay Table
430
Y
Natural - Natural Tie
435
N
Natural - Natural Win
440
N
Pay Based on Natural-Natural Loss
450
Y
Pay Based on Natural-Natural Win
445
Y
8 - 8 Tie
460
N
Pay Based on 9 -9 Tie
465
Y
Pay Based on 8 - 8 Tie
470

BACCARAT IMPROVEMENTS

BACKGROUND OF THE INVENTION

1. Field of the Invention

This invention relates to the field of casino gambling, specifically to improvements in Baccarat wagering. These embodiments may be applied to any Baccarat and Baccarat derivative games such as Mini-Baccarat, and Midi-Baccarat. This can be played in a live casino setting and also in an electronic setting via internet and via computer interface with appropriate software and algorithms.

2. Background of the Art

The most popular form of Baccarat is the punto banco Baccarat hereafter to be referred as Baccarat. The standard rules of Baccarat are known, so there is no need to inform those having ordinary skill in the art on how Baccarat is played. Baccarat is a well established casino game where using established rules, bets are placed where the object is to get closest to a point total of 9. Cards are given a point values. Cards are dealt first to the Player, then to the Banker, then to the Player and then to the Banker. There may be slight variation of rules, in various casinos but all casinos accept a natural as a point value of either 8 or 9 with the first two cards used. Furthermore, the outcomes are "Player" side win, "Banker" side win, or a "Tie". The "Player" does not refer to the betting player, nor does the "Banker" refer to the house, but rather they are just betting choice afforded the bettor.

Prior art Baccarat suffers from certain limitations, where most commonly, the main bet payoff is 1:1 for the main bet and the only other betting option is the tie bet. While Baccarat is exciting and enjoyable to play, there lacks a bet with high payout, based on a pay table. Baccarat lacks a bet that bettors can play alongside with the main bet and pays based on an outcome of a natural. Bettors have a rooting interest for a natural to occur and this bets allows them to place a bet on either Player side Natural or a Banker side Natural. Additionally, this side bet has a higher payout then the standard even money wins for Baccarat's main bet. A need exist for improvements to allow conventional Baccarat game more variations of play, to keep player's interest from waning and keep this game profitable for casinos.

There have been other attempts to improve the game of Baccarat. U.S. Pat. No. 5,362,064, Lofink discloses a Baccarat game with side bets with much higher payouts. There is even a specific side bet where a natural tie pays 50:1. U.S. Pat. No. 6,789,801, Snow describes wagering where one of the outcomes of the side bet is a natural win with payouts, either 1:1 or 2:1. U.S. Pat. No. 5,395,119, Jacob focuses on side bets where a tie is the main objective. No one has addressed just a side bet based on natural occurring in baccarat, and tying a wager on the multiple combinations resulting from a natural occurrences, which are natural-natural tie, natural-natural win, natural-natural loss, and a natural appearing only on the either the Player or Banker side. The most common outcome is the natural not occurring at all.

This invention benefits the casino with positive expectation and benefits bettors with exciting betting options with larger payouts than the main bets.

SUMMARY OF THE INVENTION

In accordance with the present invention, a side bet thereto referred to herein as a "Natural" bet, allows for increase excitement for players by allowing for higher payout than the main bet currently offered on Baccarat. Wagers are accepted on the main bets of Player, Banker or tie. A side bet may be wagered independent of the main bets, which does not affect the play of the game of Baccarat. Bettors are wagering on the side they choose will contain a natural, which is a two card count of either 8 or 9. Should both sides, the Player side and Banker side contain a natural, then there arise a possibility of a natural-natural tie with both side being 8, both side being 9, a natural-natural win where the bettor side is a nine and the other side is an eight, or a natural-natural loss where the bettor side is an eight and the other side is a nine. The Natural side bet wins if the bettor correctly predicts the side which contains a natural. Should both sides contain a natural, then the payout will be higher based on a pay table set by the establishment. Accordingly, a winning Natural side bet payout will also be set by the establishment.

The chance of a side chosen containing a natural occurs around 18.9% of the time. Bettors wagering on the Natural side bet are hoping the side they chose will contain at least a natural. If both sides contain a natural, there is a chance for a larger payout based on a pay table.

The Natural side bet indices will be on typical electronic versions of baccarat layouts with a betting spot for this specific bet.

BRIEF DESCRIPTION OF THE DRAWINGS

The accompanying flowchart sheds light on the embodiments of the present invention, as well as its features, advantages, structure and operation.

FIG. 1 is a flowchart elucidating the current method of the present invention; illustrating the Natural side bet, according to an embodiment, which is to be performed on an electronic processor.

DETAILED DESCRIPTION OF THE INVENTION

Although this invention is described with one or more preferred embodiments, the invention is not limited by the embodiments. Modifications and variations which fall within the spirit and scope of this invention are complexo. A description of the preferred embodiment is provided herein and should not be limited to the examples provided. A person having ordinary skill in the art may modify the layout, artwork, pay table, specific part shape and details. The examples provided should be construed for better understanding of the invention and functionality, rather than limiting its scope. These include playing Baccarat electronically, with bingo balls, with varying number of deck of cards, different layouts, and any other methods by those with ordinary skills may use to play Baccarat and use this invention. This invention is to encompass all variations of Baccarat. Baccarat played on varying size tables are to be included, including Mini-Baccarat and Midi-Baccarat. Version of Baccarat including but not limited to Punto banco Baccarat, Chemin de Fer, and Baccarat Banque allow for this side bet.

An electronic size Midi-Baccarat table layout modified to allow plurality of players to make wager on the Natural side bet. Each bettor has their own Natural side bet indicia where they may wager on this side bet. In addition to the standard betting spots for Baccarat, Banker, Player, Tie, each player will also have Banker side Natural and Player side Natural betting spot to wager on this side bet. All bets must be booked before any electronic cards are dealt from the electronic shoe.

FIG. 1 shows a flowchart showing the detailed exemplary method of implementing Natural side bet. We start the operation from method 400, the start of this process. At method 405, the main bets are accepted including the tie bet. At method 405 Natural side bet may also be placed. Method 410, the croupier deals a hand of Baccarat. Method 415, croupier determines whether a natural (two card point of either eight or nine) was dealt to the side the Natural side bet was wagered. If a natural was not dealt the operation moves to method 420, where the Natural side bet loses and is taken by the house and concludes with method 500 and ends. If the bettor chose a side where a natural occurred, then we moved to method 425 to determine if both the Player's side and the Banker's side was a natural. If this was not the case then we move to method 430 and pay the bettor based on a pay table and conclude with method 500 and end. If at method 425, both side had a natural, then we proceed to method 435 to see if a natural-natural tie occurred. If a natural-natural tie did not occur we move to method 440 and determine if it was a natural-natural win (9 versus 8 point value in favored of the side the bettor placed his bet) occurred. If this occurred, method 445 is executed else method 450 is executed which is a natural-natural loss. From this point, the operation concludes at method 500 which is the end. If at method 435, natural-natural tie did occur, we proceed to method 460 to see if an eight/eight tie occurred. If this is true, method 470 is executed which pays based on eight/eight tie else we proceed to method 465 which pays based on a nine/nine tie. Once we are at either method 465 or 470, we concluded at method 500 and end. From here these method can be repeated for the next hand of Baccarat.

The outcome of the Natural side bet will be paid on a pay table. This payout will be clearly know to all bettors either by being printed on the felt, printed on a rack card, displayed on a screen, or conveyed by any other methods such that the bettors know the payout for the Natural bet. One possible pay table is as follows for the Natural side bet. Bettor does not bet on the side with the natural; losses his wager. If the side he wagers is the only side with a natural, he is paid 3:1. If it is natural/natural tie with a point value of both sides being an eight, the bettor is paid 10:1. If it is a natural/natural tie with a point value of both sides being a nine, the bettor is paid 15:1. For a natural/natural win, the bettor is paid 25:1. For a natural/natural loss, the bettor is paid 3:1. This pay table is set as a guide and should not be considered limiting in scope. Pay table may be adjusted in payout value but never set to give the house an edge greater than what is set by the jurisdictions allowing this bet.

Some possible pay tables are as follows.

TABLE A

| | Pays |
|---|---|
| Choose the only side with the natural | 2 to 1 |
| Both player side and banker side is a natural | |
| natural-natural tie (8 vs 8) | 10 to 1 |
| natural-natural tie (9 vs 9) | 15 to 1 |
| natural-natural win (9 vs 8) | 25 to 1 |
| natural-natural loss (8 vs 9) | 2 to 1 |
| All other bets results in a loss | |

TABLE B

| | Pays |
|---|---|
| Choose the only side with the natural | 2 to 1 |
| Both player side and banker side is a natural | |
| natural-natural tie (8 vs 8) | 8 to 1 |
| natural-natural tie (9 vs 9) | 15 to 1 |
| natural-natural win (9 vs 8) | 25 to 1 |
| natural-natural loss (8 vs 9) | 2 to 1 |
| All other bets results in a loss | |

TABLE C

| | Pays |
|---|---|
| Choose the only side with the natural | 2 to 1 |
| Both player side and banker side is a natural | |
| natural-natural tie (8 vs 8) | 7 to 1 |
| natural-natural tie (9 vs 9) | 15 to 1 |
| natural-natural win (9 vs 8) | 25 to 1 |
| natural-natural loss (8 vs 9) | 2 to 1 |
| All other bets results in a loss | |

TABLE D

| | Pays |
|---|---|
| Choose the only side with the natural | 2 to 1 |
| Both player side and banker side is a natural | |
| natural-natural tie (8 vs 8) | 7 to 1 |
| natural-natural tie (9 vs 9) | 15 to 1 |
| natural-natural win (9 vs 8) | 25 to 1 |
| natural-natural loss (8 vs 9) | 2 to 1 |
| All other bets results in a loss | |

TABLE E

| | Pays |
|---|---|
| Choose the only side with the natural | 3 for 1 |
| Both player side and banker side is a natural | |
| natural-natural tie (8 vs 8) | 10 for 1 |
| natural-natural tie (9 vs 9) | 15 for 1 |
| natural-natural win (9 vs 8) | 25 for 1 |
| natural-natural loss (8 vs 9) | 3 for 1 |
| All other bets results in a loss | |

The details and specifications in the claims are meant to elucidate the advantages of the invention, not meant to be limiting the scope of the invention. Suitable modifications, design of the layout, varying pay tables, and equivalents which fall within the spirit and scope of this invention may be deemed covered by the following claims.

What is claimed:

1. A method of playing a side bet for Baccarat game, including such variations as punto banco Baccarat, Chemin de Fer, Baccarat Banque, Midi-Baccarat, Mini-Baccarat, Neveda-style Baccarat, Scarney Baccarat and any other variations of Baccarat where the first two cards dealt to both Player's side and Banker's side has a possibility of being a natural (two card point value of either eight or nine), as conventionally known in the game of Baccarat, said method comprising the steps of:

a) performing, on an electronic processor, the operation of: allowing at least one bettor to place a wager on a side on either the main bet of Player, or Banker, or Tie;

b) performing, on an electronic processor, the operation of: allowing at least one bettor to wager on a Natural side bet;

c) performing, on an electronic processor, the operation of: the computer dealing at least one Player's hand and a Banker's hand in a manner consistent with the rules of Baccarat;

d) performing, on an electronic processor, the operation of: resolving the main bet with the rules of Baccarat;

e) performing, on an electronic processor, the operation of: resolving the Natural side bet based on the placed wager on the side with a natural and, on all occurrences of a natural, paying out on a pay table.

2. The method of claim 1 wherein the outcome of the Natural side bet are: performed on an electronic processor, the operation of:

a) where the side wager on contains no natural, a two card value or either 8 or a 9, which results in a loss of the Natural side bet;

b) where the side wager on does not contain a natural, and the other side does, which results in a loss of the Natural side bet;

c) where the side wager on only contains a natural, and the other side does not, which results in a payout of the Natural side bet based on a pay table, paying 2:1;

d) where both sides contains a natural with a point value of 8 which results in a payout for the Natural side bet based on a pay table, paying 5:1;

e) where both sides contains a natural with a point value of 9 which results in a payout for the Natural side bet based on a pay table, paying 15:1;

f) where both sides contains a natural where the side wager on has a two card point value of 9 and the other side has a two card value of 8, which results in a payout for the Natural side bet based on a pay table, paying 25:1;

g) where both sides contains a natural where the side wager on has a two card point value of 8 and the other side has a two card value of 9, which results in a payout for the Natural side bet based on a pay table, paying 2:1;

h) where the Natural side bet are awarded according to different pay tables to suit the needs of the establishment offering this bet.

* * * * *